United States Patent [19]

Biagiotti

[11] Patent Number: 5,038,647

[45] Date of Patent: Aug. 13, 1991

[54] CUTTING-OFF MACHINE FOR CUTTING LOGS OF PAPER MATERIAL AND THE LIKE

[75] Inventor: Guglielmo Biagiotti, Lucca, Italy

[73] Assignee: Perini Navi S.p.A., Lucca, Italy

[21] Appl. No.: 502,694

[22] Filed: Apr. 2, 1990

[30] Foreign Application Priority Data

Apr. 5, 1989 [IT] Italy ..... 9393 A/89

[51] Int. Cl.[5] ..... B26D 3/16; B26D 7/12

[52] U.S. Cl. ..... 83/155.1; 83/174; 83/276; 83/282; 83/458; 83/466; 83/466.1; 83/817

[58] Field of Search ..... 83/13, 54, 171, 207, 83/268, 276, 282, 466.1, 801, 451, 458, 460, 744, 761, 174, 423, 466, 817, 820, 788, 155.1

[56] References Cited

U.S. PATENT DOCUMENTS

| | | | |
|---|---|---|---|
| 638,461 | 12/1899 | Houghton | 83/458 |
| 3,049,954 | 8/1962 | Barlament et al. | 83/207 X |
| 3,905,260 | 9/1975 | Nystrand | 83/174 X |
| 4,329,895 | 5/1982 | Perini | 83/174 |
| 4,347,771 | 9/1982 | Bradley | 83/174 |
| 4,579,025 | 4/1986 | Fasolak | 83/801 X |

*Primary Examiner*—Frank T. Yost
*Assistant Examiner*—Kenneth E. Peterson
*Attorney, Agent, or Firm*—Francis J. Bouda

[57] ABSTRACT

A machine is described for cutting large diameter wound logs of paper or similar web material such as toilet tissue and the like into relatively small discs for use specially in institutional dispensers. The machine includes a cradle and transport means for inserting a large diameter log of paper into a gripper which holds the log securely and stationary while a band saw cuts the discs of paper from the log. The gripper includes a ring through which the log passes, said ring including a plurality of radially movable plungers which support and retain the log within the ring while the band saw is cutting a disc from the log. The mechanism also includes an automatic guide and sharpening station for maintaining the sharpness of the band saw and, furthermore, includes a support and discharge mechanism for removing the discs of paper from the gripper.

10 Claims, 14 Drawing Sheets

III
1
6
4
5
$f_B$
$f_{B'}$
B
B
B'
3
3
IV
IV
23
A
7
11
18
17
22
6
13
8
9
20
19
21
15
10
14
II
II
A
III

Fig.9
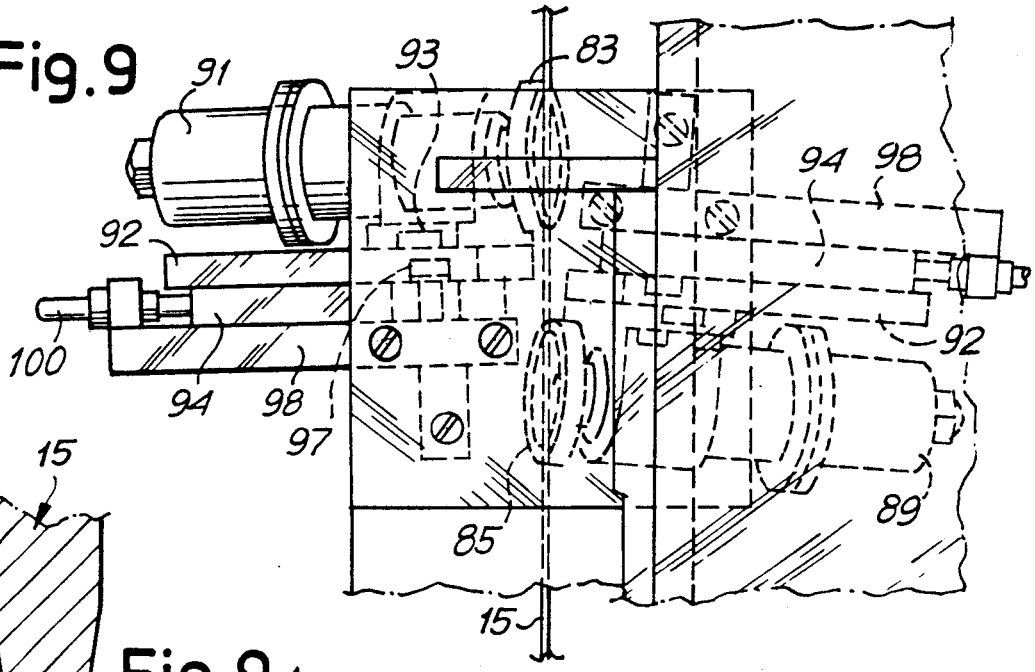
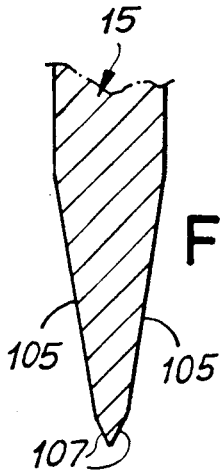
Fig.9A
Fig.10
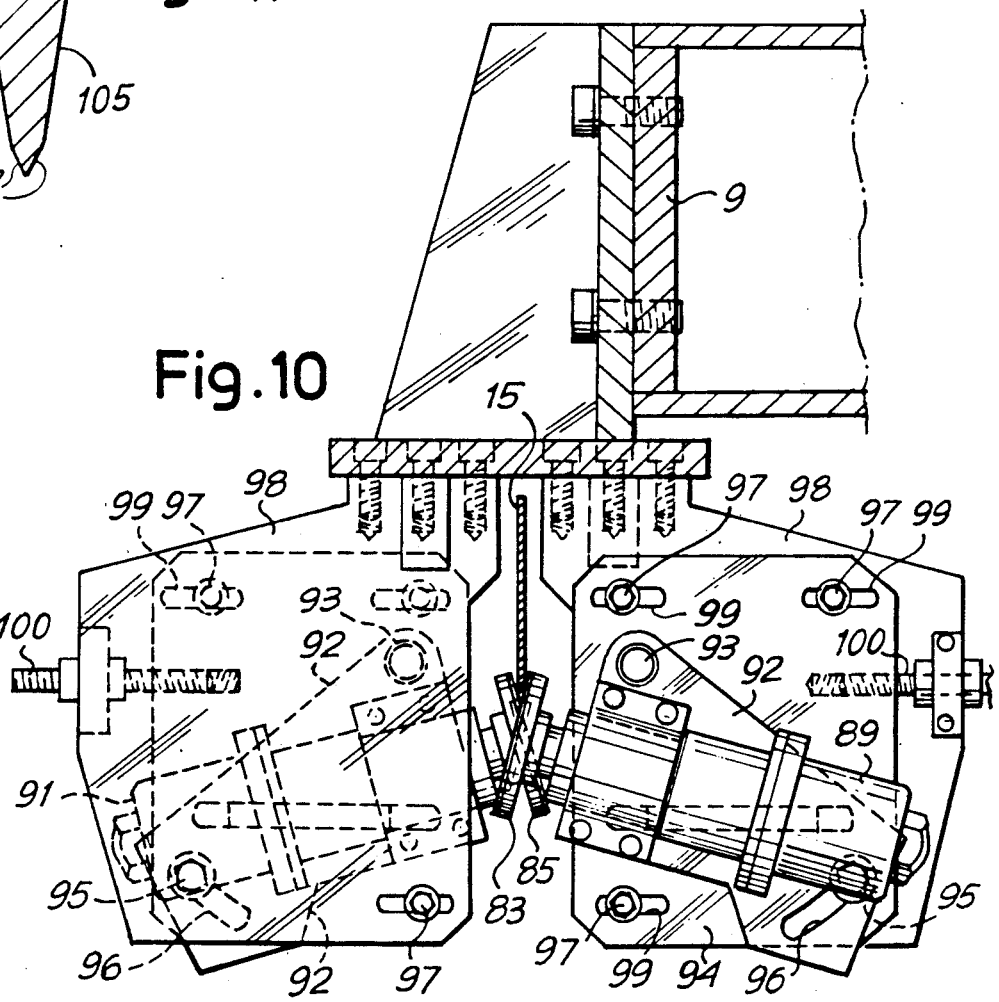

Fig. 17
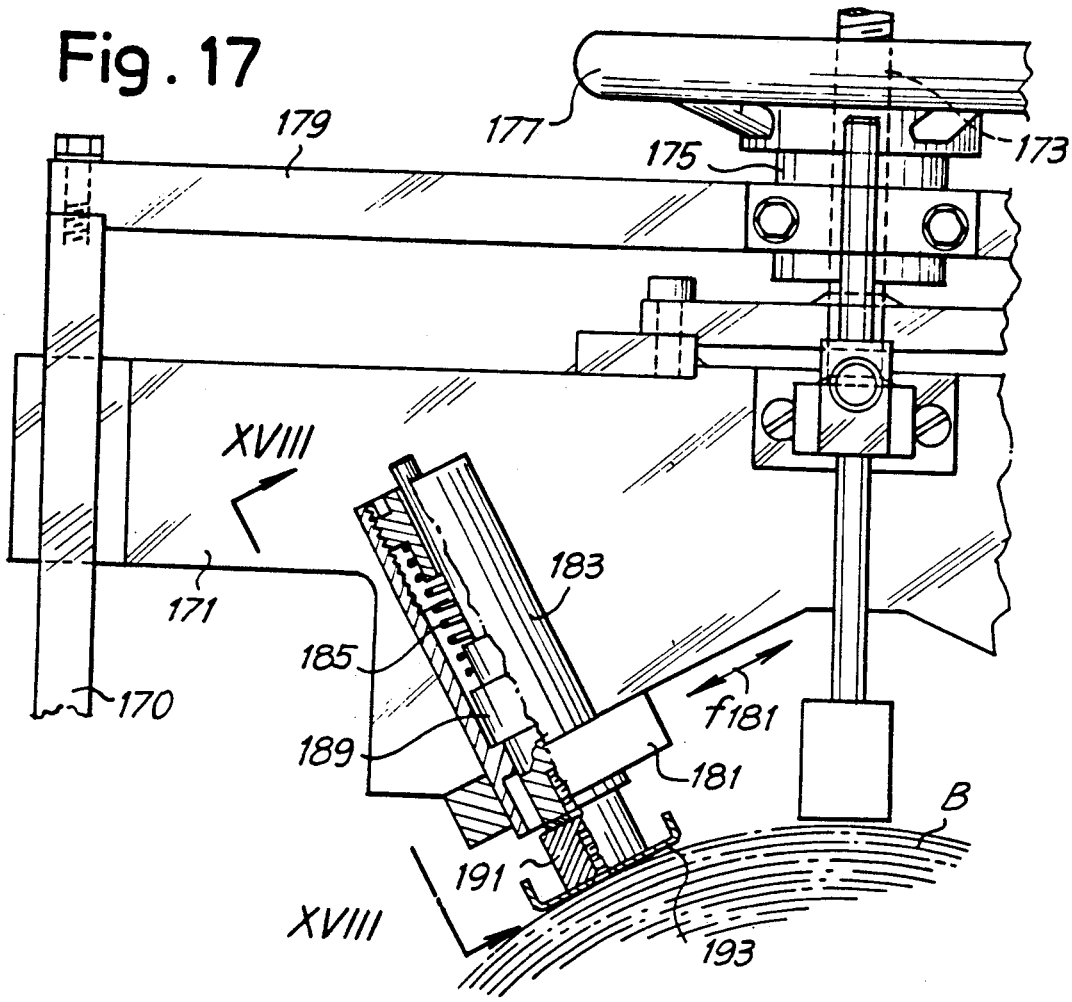
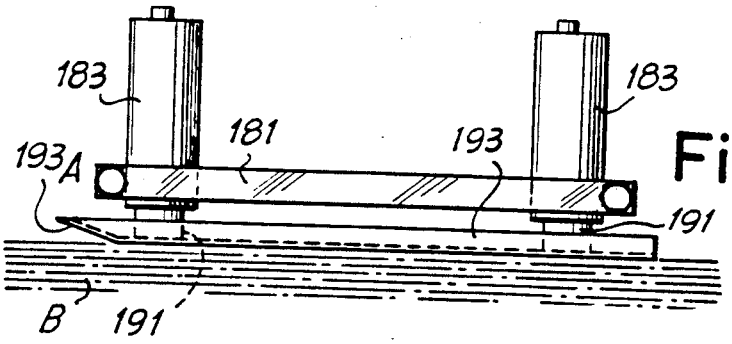
Fig. 18
Fig. 19
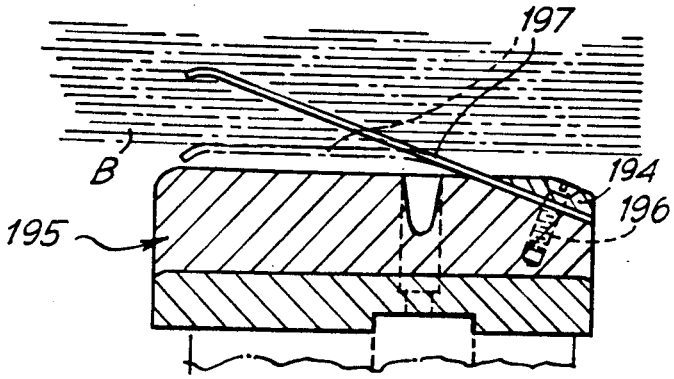

CUTTING-OFF MACHINE FOR CUTTING LOGS OF PAPER MATERIAL AND THE LIKE

BACKGROUND OF THE INVENTION

It is well-known in the art how to prepare long rolls of tissue paper or the like, generally called "logs" rewinding equipment. The sheets which may be as wide as 5.0 meters are wound on a cardboard core, and these 5.0 meter long "logs" generally have an external diameter of 4" to 5".

After the logs are prepared, it is necessary to cut them into discreet lengths of approximately 5", which is the customary width to fit in the standard toilet-roll dispensing device in bathrooms and the like.

Log saws have been shown in many patents as, for instance, in U.S. Pat. Nos. 4,370,140; 3,213,734; 4,173,846 and 3,512,437.

Each of these devices have had one or more disadvantages which are overcome by the present invention, because the prior art fails to teach how, during the cutting operation, the logs can be guided, advanced, held during cutting, and then discharged, all while the rotary cutting saw or other cutting means moves back and forth on an arm provided with reciprocating or oscillating motion.

More importantly, and more recently, it has been desirable to produce rolls of toilet paper having a large external diameter.

In public premises, offices, industrial buildings and the like, there are frequently utilized paper rolls of large diameter, up to over 400 mm, for various uses, especially for sanitary use. These rolls are currently produced by unwinding a paper material from a long coil and by rewinding them onto a plurality of cores. The paper material unwinding from the coil is cut along lines parallel to the unwinding direction to form a plurality of strips of desired width. Each strip is rewound on a core thus forming a plurality of rolls.

During the unwinding, the cutting and the rewinding, the strips of paper material are disposed, side-by-side and, upon the simultaneous winding of more strips, there occur frequent overlappings between the edges of strips which are wound on adjacent cores. The formed rolls then overlap each other, are no longer detachable and, therefore, unusable.

Moreover, the production of rolls according to the above-mentioned technique implies the further disadvantage that the operation is discontinuous, that is to say, of start-stop type. This implies that the entire operation must be stopped upon the completion of a series of rolls in order to remove said rolls and replace them with empty cores in order to restart the production.

When it is desired to carry out an embossing, printing, or other working prior to the formation of the rolls so as to form a paper web having individual characteristics, all the element of the plant which perform the works on the web must cyclically be stopped and restarted. This is impossible in many cases owing to the high inertia of the embossing or printing rollers, for example. It thus follows that for rolls of large diameter produced according to the known technique, it is necessary to eliminate this type of personalization so that the finished roll is made up of a web lacking in impressions, embossments, decorations, personalizations, or other characteristics that might improve the commercial value thereof.

OBJECTS OF THE INVENTION

Thus an object of the invention is to provide an apparatus for the production of paper rolls of large diameter which does not exhibit the above-mentioned drawbacks, and which, in particular, is able to reduce waste, increase the productivity through a continuous working cycle, and carry out embossings, printings or the like, suitable for increasing the commercial value and the quality of the product.

The apparatus according to the invention comprises means for the support and longitudinal guiding of one or more logs to be cut, means for the advancement of said logs, means for controlling the advancement of the log, a gripper or clamping group able to retain said log(s) during the cut, and cutting means mounted on an arm provided with reciprocating or oscillating motion.

In practice, the cutting means may comprise a bandsaw blade with a smooth cutting edge, driven between two flywheels supported by said arm, with one of said flywheels driven into rotation by corresponding motor means in order to make the cut.

The gripper group comprises pressure means located at either sides of the operative zone of the cutting means; said gripper means compressing the log and retaining the roll during the cutting.

In order to produce the rolls of paper material in web shape, the log is advanced under intermittent control along the guide, and stopped at a suitable position to allow said cutting means to perform the cutting of the log near said gripper means which, by compressing the log during the cut, allow a correct operation to be carried out.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized, and that the invention is not limited to the precise arrangements and organizations of the instrumentalities as herein shown and described.

In the drawings, wherein like reference characters indicate like parts:

FIG. 9 shows a plan view of the first blade-sharpening unit.

FIG. 9A shows a local transverse section of the edge of the band blade.

FIG. 10 shows a side view of the first sharpening unit of FIG. 9.

FIG. 17 shows a front view of the device for controlling the log advancement.

FIG. 18 a local and partial section taken on line XVIII—XVIII of FIG. 17.

FIG. 19 shows a modified embodiment of the buffer or link block for the blocking of the log in the gripper group.

Figure 20:
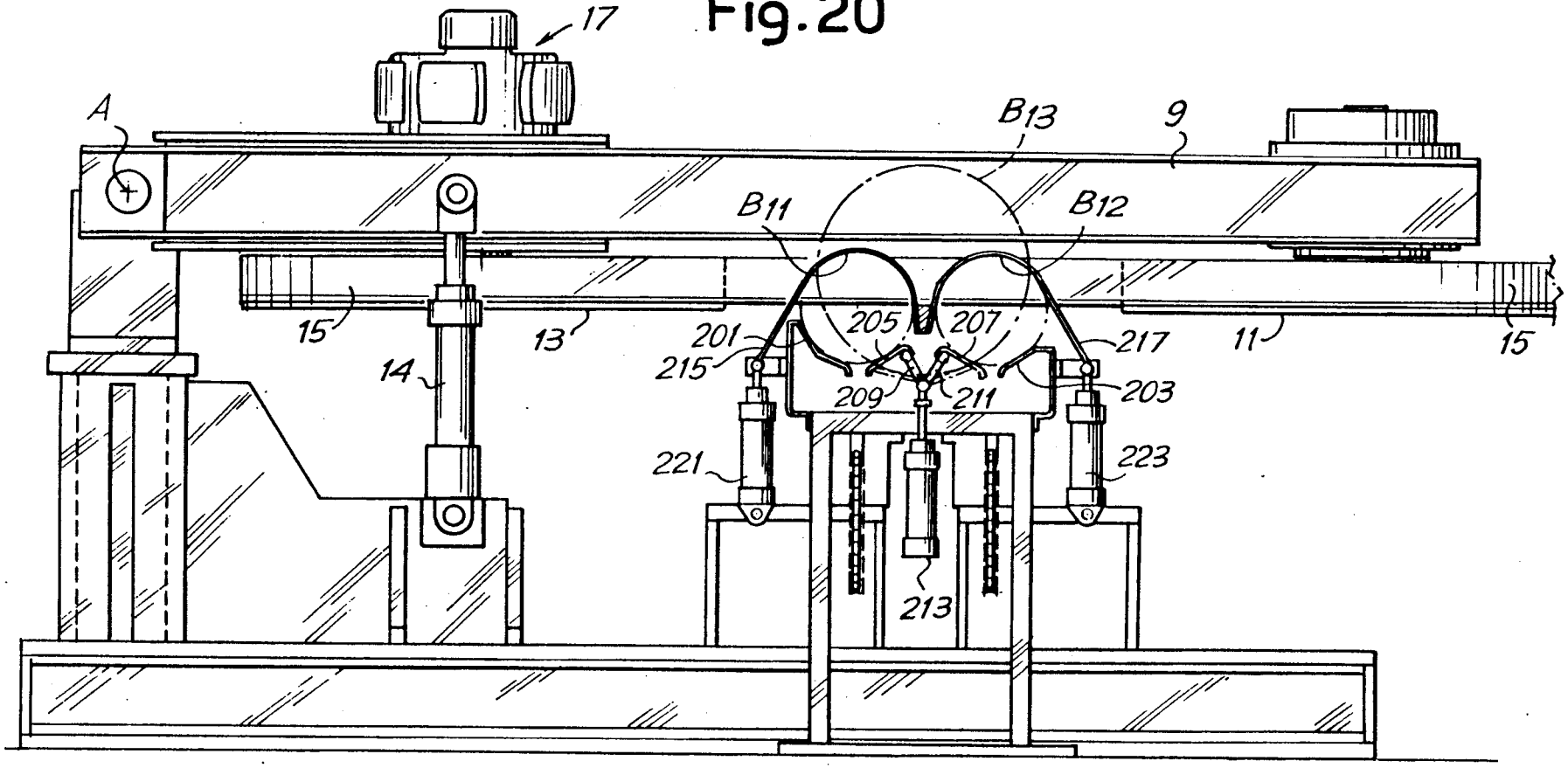

FIG. 20 shows a front view of a cutting-off machine in a modified embodiment thereof.

Figure 1:
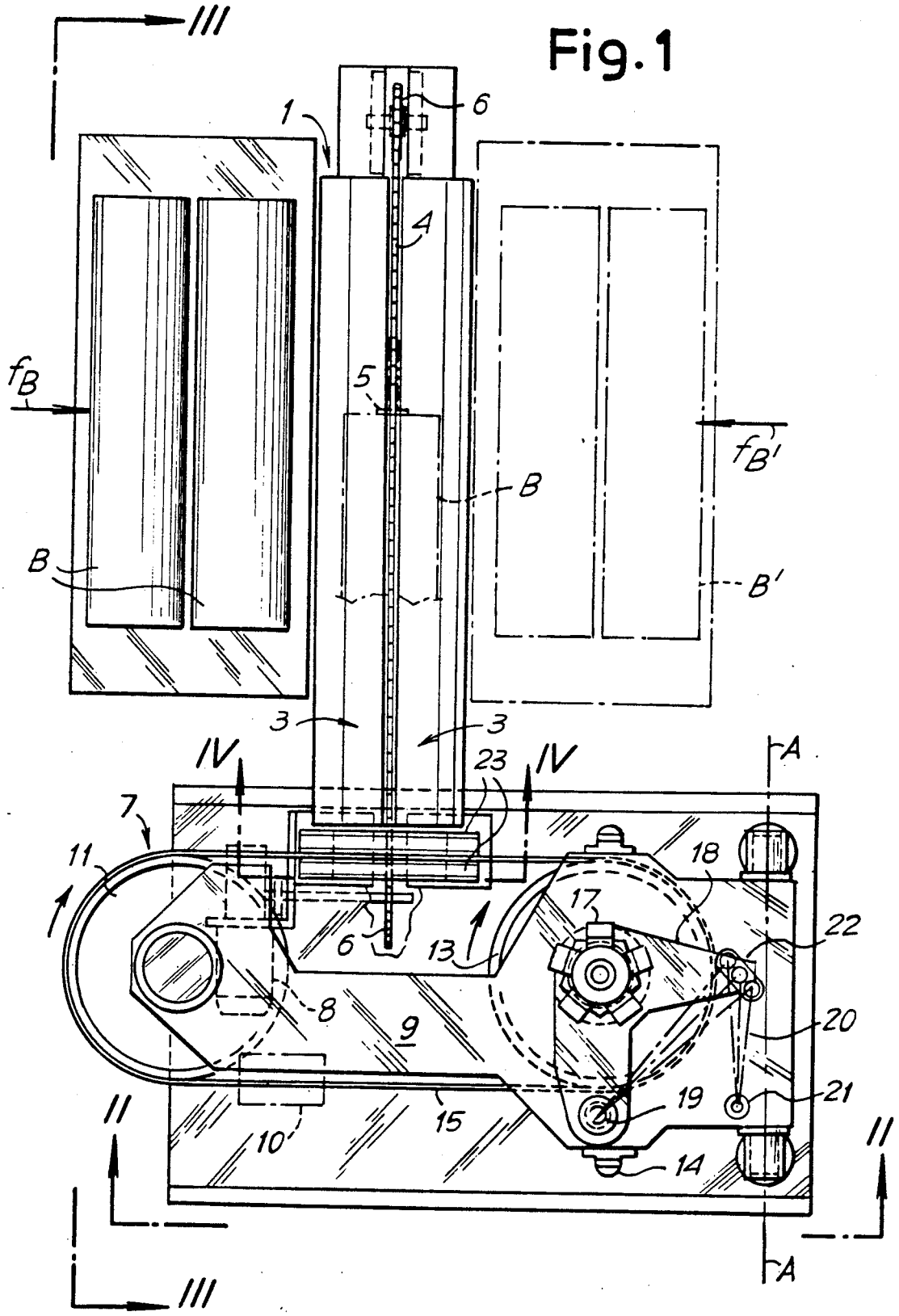
FIG. 1 shows a diagrammatic plan view of the apparatus according to the invention.
Figure 2:
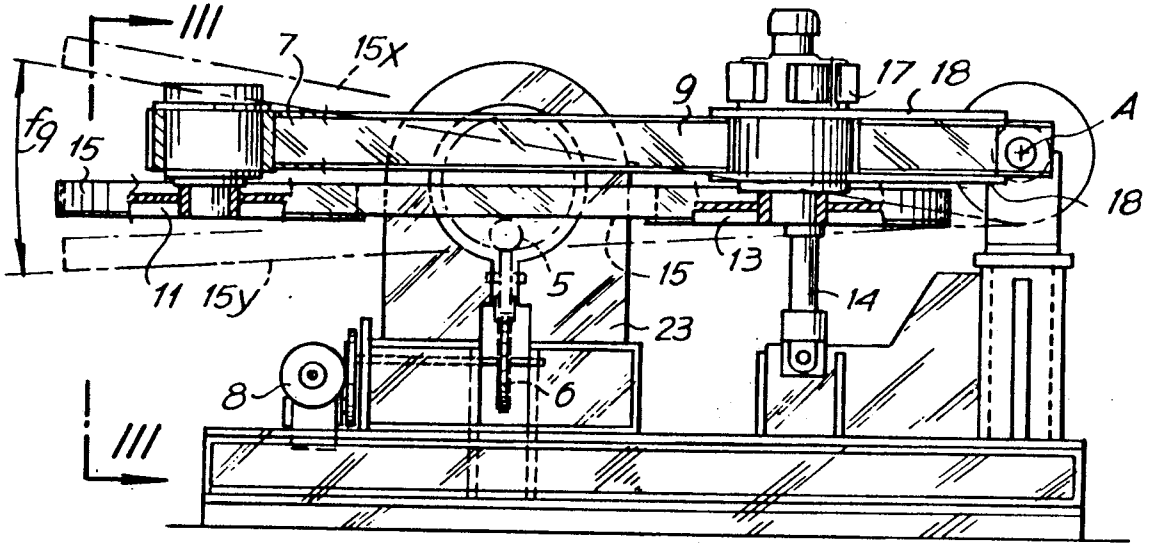
FIG. 2 shows a view taken on line II—II of FIG. 1.
Figure 3:
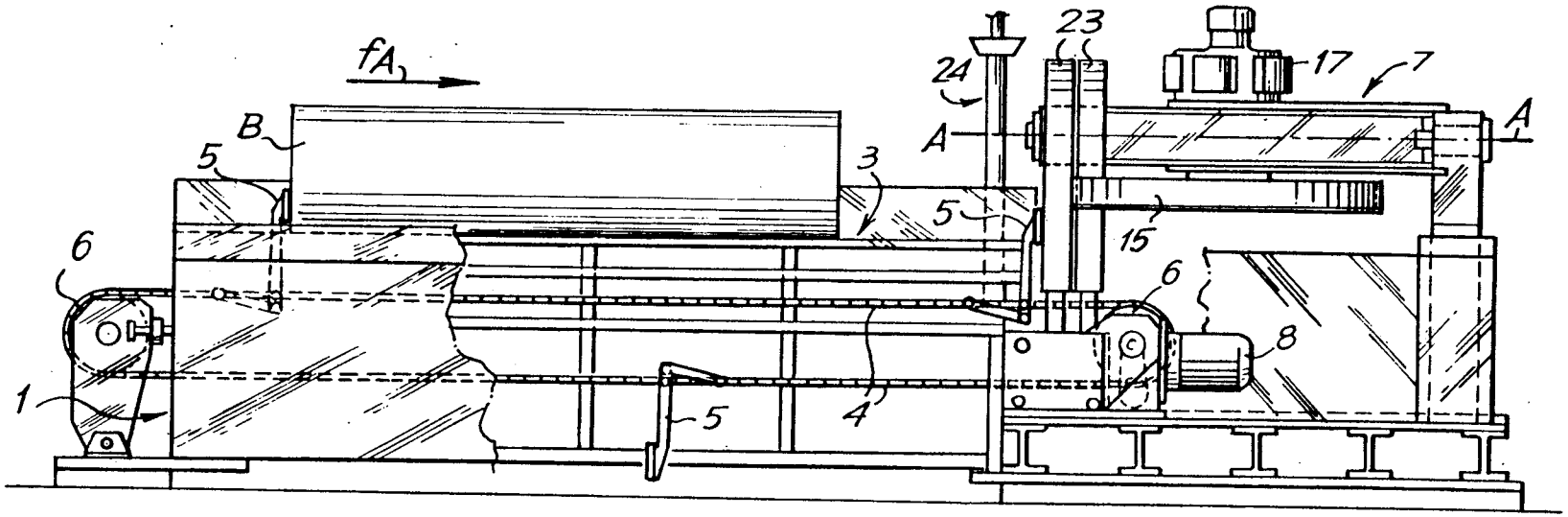
FIG. 3 shows a side view taken on line III—III of FIGS. 1 and 2.

A first embodiment of the apparatus according to the invention is schematically illustrated in FIGS. 1 to 3, while the remaining figures show details of parts of the same apparatus and/or modified embodiments thereof.

With first reference to FIGS. 1 to 3, the apparatus according to the invention comprises a frame 1 on which a pair of guides 3 are mounted (as described below in greater details with reference to FIG. 7) on which the logs B to be cut in rolls are supported. The logs B may be fed in the direction of fB or in the direction of fB' (in the latter case the logs are shown in broken lines and designated by B') according to the apparatus arrangement and to the requirements of the plant in which the apparatus is to be integrated.

Any log B, which is on the guides 3, is moved by a pusher 5 (or by other suitable means) towards a cutting station generally indicated by 7. The pushers 5 are carried by a flexible means 4, such as a chain, driven between wheels 6, one of which is driven into rotation by a motor 8. The advancement of the log may, however, be achieved in other suitable ways.

The cutting station comprises an arm 9 articulated about a horizontal axis A—A to oscillate through an arc in the directions of the double arrow f9. The arm 9 carries a pair of flywheels 11, 13 on which a band blade is driven. The flywheel 11 is the driven one, While the flywheel 13 is the driving one, the latter being actuated by a motor 17 or other suitable motor means. The oscillation of arm 9 is determined by an actuator 14 such as a cylinder-piston or the like.

The flywheel 13 and the relevant motor 17 are mounted on a dual L-shaped bracket 18, articulated at 19 to the arm 9 and able to oscillate around said articulation point 19 by a cylinder-piston actuator 20, or by other suitable means, anchored at 21 to said arm 9 and at 22 to the dual bracket 18. The oscillation about the pivot 19 of the flywheel 13 and of relevant motor 17, carried by the dual bracket 18, allows the band blade 15 to be suitably tensioned. On the arm 9, at a suitable position generally indicated by 10, guiding and sharpening means are mounted for the blade 15 which will be described later in greater details with reference to FIGS. 9 to 14.

To carry out the cutting, log B is made to advance intermittently in the direction of fA by the pusher 5 (FIG. 3) towards one of the branches of the band blade 15. Facing the guide means 3, between the loading zone and the band blade, means able to control the advancement of log B and to prevent the advancement of log B by inertia are disposed generally indicated by 24 in FIG. 3 and described in greater detail with reference to FIGS. 17 and 18.

Between one feeding stroke and the next, the arm 9 oscillates in the direction f9 to carry out the cutting of the log. In the operating zone of the band blade, a gripper group is provided, generally indicated by 23 and to be described later in more details with reference to FIGS. 4 to 6. The gripper group 23 holds the log during the cutting and releases it for the successive feeding stroke and also has means for guiding the band blade 15.

In FIG. 2, 15X and 15Y indicate the positions of maximum lifting and maximum lowering of the cutting edge of blade 15, while the arm 9 is shown in a horizontal, intermediate position.

Figure 4A:
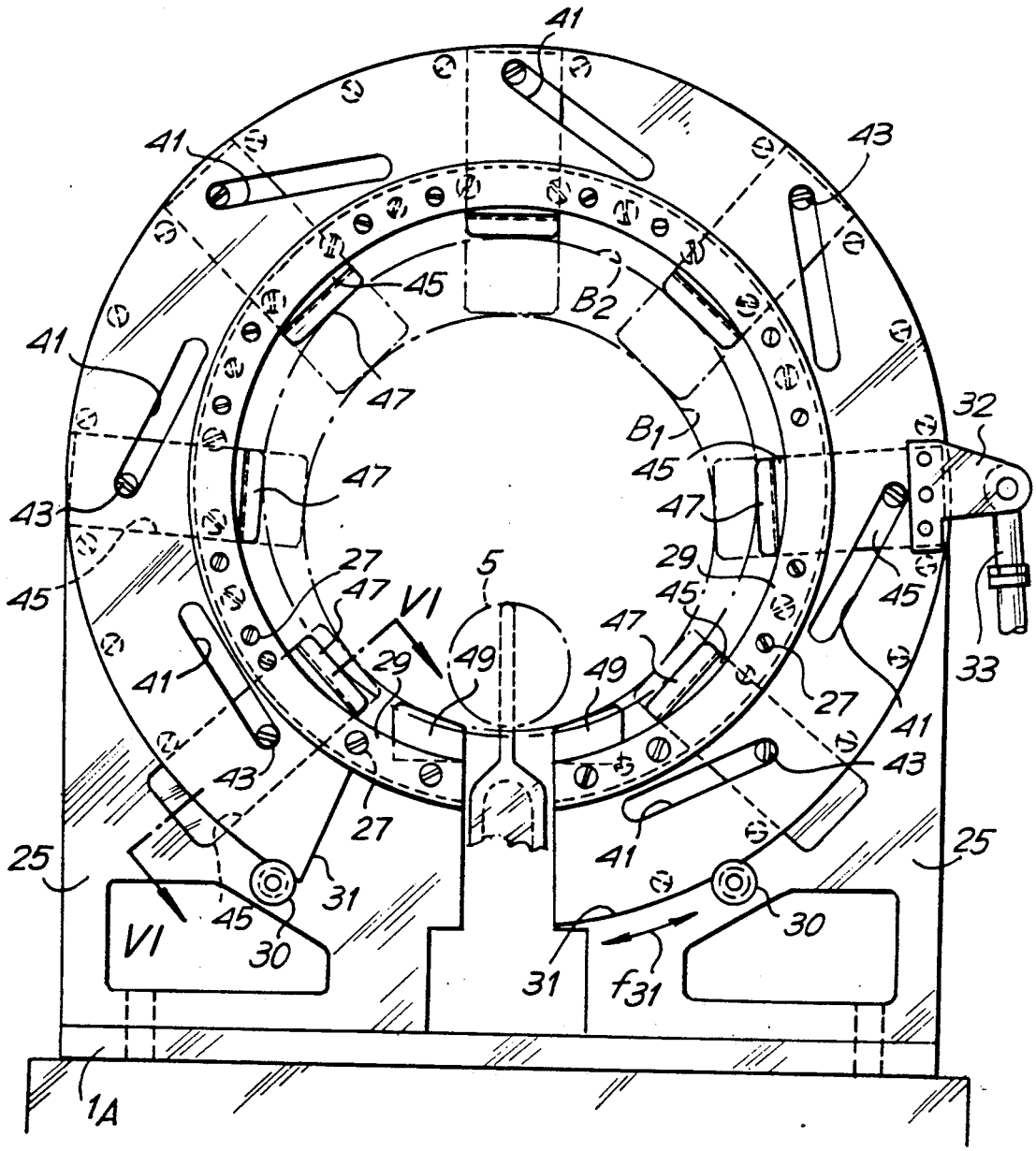
FIGS. 4A and 4B show a partial local view of the gripper group taken, on line IV—IV of FIG. 1, in two different embodiments.

FIGS. 4A to 6 show the gripper group 23 in greater details. More particularly, FIG. 4A shows, in a first embodiment, a front view of a first one of two gripper members which are separated from each other so as to leave a space sufficient for the band blade 15 to pass between. With reference to the gripper member of FIG. 4A, it comprises a frame 25 solid to a plane lA forming part of the apparatus frame 1. The frame 25 forms a circular seat for the transit of the log B to be cut.

On the frame 25 a first fixed ring 29 is applied by means of screws 27, which has an annular step 29A (FIG. 6) forming a guiding seat for a second ring 31, movable with respect to frame 25, which is engaged to the same frame through a annular step 31A cooperating with the step 29A of the fixed ring 29.

Figure 5:
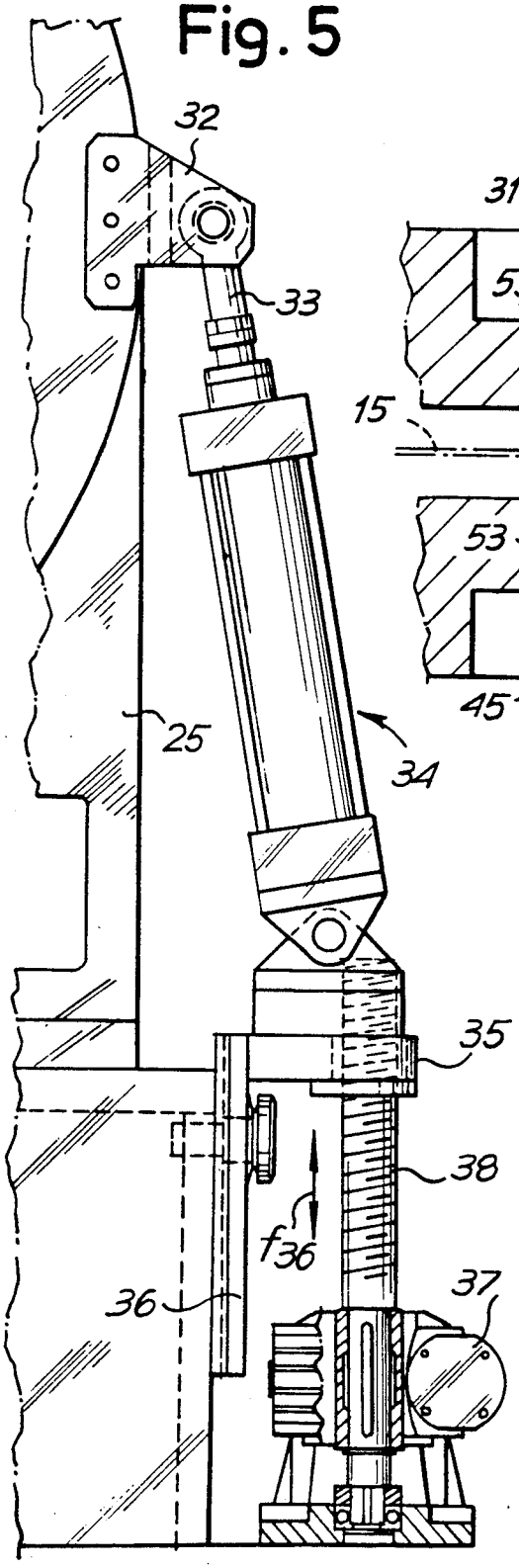
FIG. 5 shows a detail of the actuator for the opening and closing of the gripper group.

Connected at 32 to the movable ring 31 is a stem 33 of a cylinder-piston system 34 (FIG. 5). The cylinder-piston system 34 rotates the movable ring 31 in one direction or the other of double arrow f31. The cylinder piston system 34 is engaged to plate 35 fixed to a slide 36 movable along suitable guides to be displaced in the directions of double arrow f36. The movement of slide 36 and thus of plate 35 and cylinder-piston 34 is operated by an actuator 37 which drives into rotation a threaded bar 38 engaged to plate 35. By making the cylinder pivot of said cylinder-piston system movable, it is possible to vary the end positions taken up by the movable ring 31 during its rotation operated by said cylinder-piston system 34. This allows the movement of the movable ring 31 and of the members driven thereby to be adapted to the various dimensions of the logs to be cut, as described below.

During its rotation, the movable ring 31 is guided, not only by the fixed ring 29, but also by one pair of rollers 30 located near the lower portion of the same movable ring 31. Both the movable ring 31 and the fixed ring 29 have a gap in their lower portion, to allow the passing of pusher 5 therethrough.

The rotation of the movable ring 31 in one direction or the other, actuated by the cylinder piston 34, is limited to some degree, but is sufficient to operate the opening and the closing of the gripper means and hold the log B during the cutting operations. To this end, the movable ring 31 has a plurality of slots 41 disposed at an angle to the radius of the ring. The angle of the slots 41, with respect to the radius, is not the same around the circumference of the movable ring 31, for the purposes indicated below.

In each slot 41 is a follower 43 which is also fastened to a slide 45. Slide 45 is guided within suitable radial seats of the frame 25 and carries a buffer or link block 47 which engages the cylindrical surface of the log B to be cut. The buffers 47 face towards the center of the circular seat for the log transit and thus to the axis of the log to be cut. When the movable ring 31 is rotated by the cylinder-piston 34 in one direction or the other, the displacement of the inclined slots 41 causes the radial movement of the slides 45 within their seats and thus of buffers 47 which move against the cylindrical surface of the log B placed in the seat defined by the frame 25.

FIG. 4A shows two logs of different diameters, indicated by B1 and B2, respectively. The diameter of said two logs corresponds approximately to the minimum and maximum diameter, respectively, of the logs that can be received into the transit seat defined by the frame 25.

As previously mentioned, in the embodiment of FIG. 4A the angle of slots 41 relative to the radial direction differs along the circumferential development of the movable ring 31. This allows a correct movement of slides 45 and of buffers 47 which must simultaneously contact the cylindrical surface of the log B regardless of the diameter thereof, considering that the said log always rests on a pair of fixed guides 49 disposed in the lower part of the seat for the transit of the log. FIG. 4A clearly shows the different positions of the various slides 45 according to their circumferential position around log B1 and B2 respectively.

Figure 6:
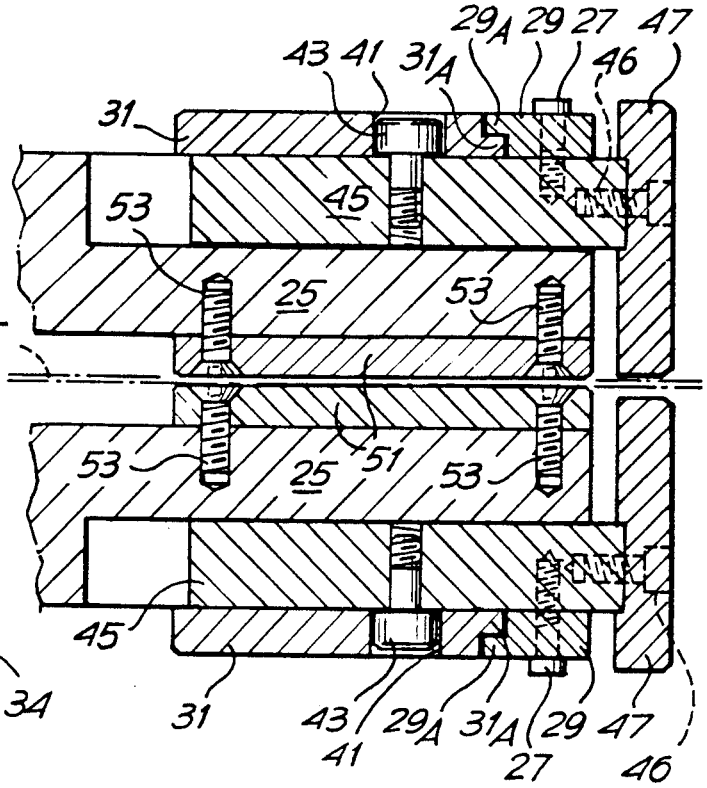
FIG. 6 shows a local section taken on line VI—VI of FIG. 4A.

In FIG. 4A, link blocks 47 are fastened to the corresponding slides 45 by screws 46 (FIG. 6). Thus they can be changed according to the dimensions of the logs to be cut. For example, for logs of smaller diameter, there may be provided buffers 47 of greater length--that is to say, protruding to a greater extent towards the center of the log transfer seat. Moreover, various sets of buffers or link blocks may be provided in which the surface in contact with the log can take different profiles to better fit the shape thereof. In a modified embodiment, the buffers can be pivotally fastened to the respective slides so as to better fit the profile of the log to be engaged.

As logs of significantly different diameter can be cut by the same cutting-off machine, it is appropriate that the travel of the slides 45 and of buffers 47 be adjustable according to the diameter of the log to be cut. This minimizes the time necessary for the clamping of the buffers or link blocks 47 onto the log. The modification of the travels of slides 45 is made possible by adjusting of the position of the cylinder-piston system 34 engaged to plate 35. In fact, as the stroke of stem 33 of the cylinder-piston system 34 is constant, the variation of the position of the cylinder causes the variation of the end positions taken up by the stem 33 and thus the positions of the movable ring 31 rotated by the same cylinder-piston system 34. It thus follows that, by varying the position of the cylinder-piston system 34 by means of actuator 37, it is possible to vary the opening positions of slides 45 and of buffers or link blocks 47 by adapting them each time to the dimensions of the logs to be cut, thereby reducing the stroke as well as the time required for the opening.

As shown in FIG. 6, the gripper group 23 comprises a pair of frames 25 disposed one opposite the other and equipped with similar log-gripping members spaced apart sufficiently to allow the passing of the band blade 15 which has to perform the cutting of log B. During the cutting, the band blade 15 is guided by two fixed rings 51 facing each other and fastened by screws 53 to the adjacent frames 25. During the cutting of the log, the buffers 47 associated to the two frames 25 clamp the log B at the two areas immediately before and immediately after the zone in which the cutting is to be performed.

To carry out the cutting of each roll, the log is moved in the direction fA until the section thereof in which the cut is to be performed is in alignment with the band blade, that is to say, in the slit defined by the two facing rings 51. At this point, the buffers 47 are moved against the cylindrical surface of log B. To accomplish this, the movable ring 31 is moved counter-clockwise by the cylinder-piston 34 from the position shown in FIG. 4A up to the position in which the buffers 47 come simultaneously in contact with the surface of the log and, by pressing against the latter, allow the correct and precise execution of the cut.

When the log B is firmly clamped by the buffers 47, the band blade 15 moves through its cycle, thereby cutting the log B. When the band blade has carried out the cut and has been moved away from the cutting zone defined by the two facing rings 51, the buffers 47 are moved away in a radial outward direction by rotating the movable ring 31 clockwise. The subsequent advancement of log B determined by the pusher 5 allows the discharge of the cut roll and the positioning of the same log between the two frames 25 for a successive cutting operation.

Figure 4B:
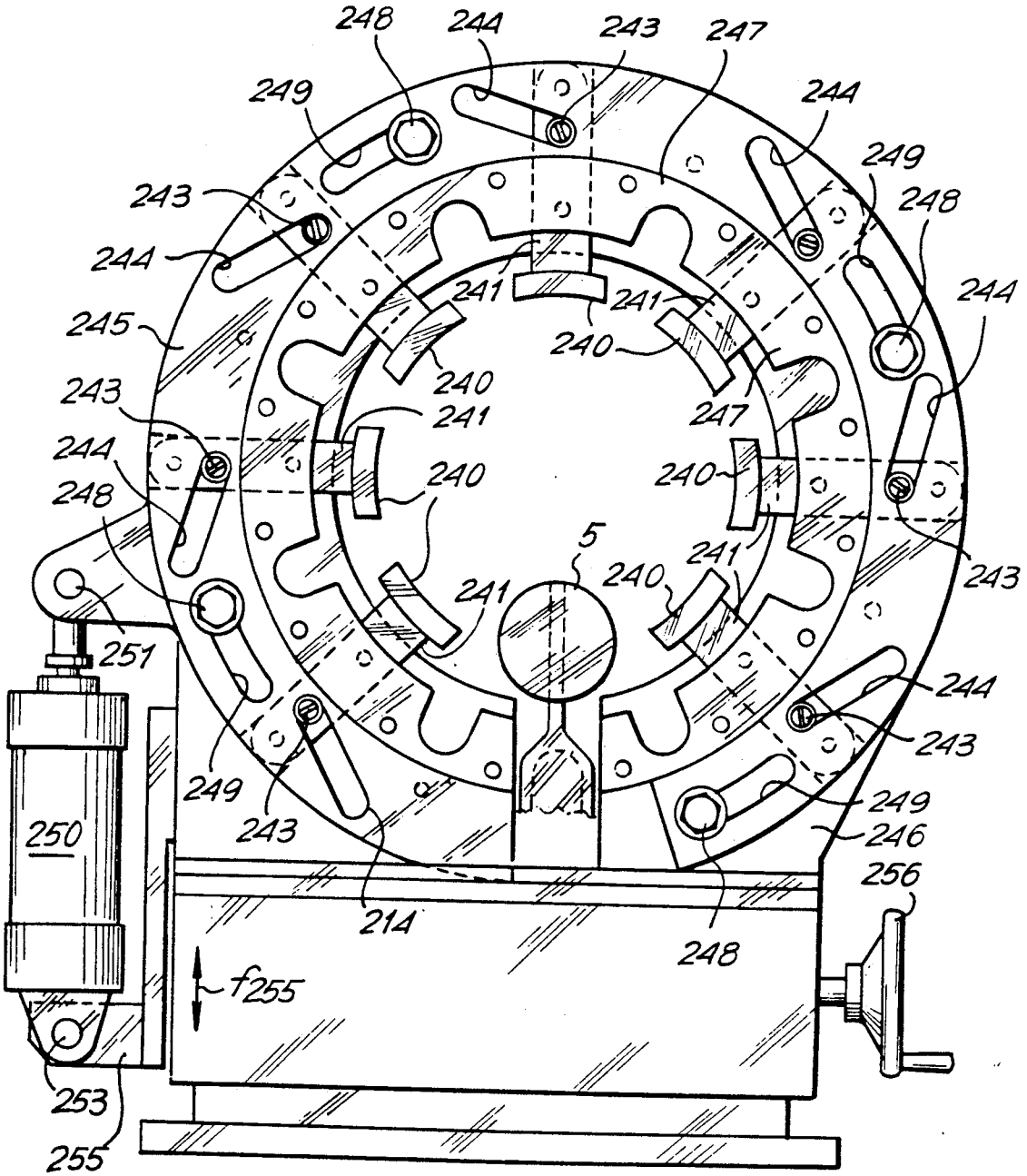

FIG. 4B shows an embodiment of the gripper group in which buffers 240 are movable in a self-centering way on slides 241. In order to control the radially inward motion of slides 241 and of relevant buffers or link blocks 240, each slide 241 is fastened to a respective follower 243 sliding within a corresponding inclined slot 244 of a ring 245 angularly movable in an oscillating manner. The movable ring 245 is guided on a fixed structure 246 by a fixed ring 247 forming a guide similar to the one formed by the fixed ring 29 of the embodiment of FIG. 4A. To further guide the movable ring 245, fixed pivots 248 are provided on structure 246 which engage within sliding slots 249 formed in the movable ring 245.

The opening and closing of the gripper group is operated by a cylinder-piston actuator 250 connected at 251 to the movable ring 245 and at 253 to a slide 255 vertically adjustable according to the double arrow f255 for the purpose already indicated with reference to the embodiment of FIG. 4A. The means for adjusting the position of slide 255 may be similar to those described with reference to FIG. 5 and are not indicated in FIG. 4B.

To keep the center of convergency of slides 241 in alignment with the logs of different diameter which are to be cut, the fixed structure 246, and thus the set of slides 241 and relevant buffers and link blocks 240, can be moved vertically by an adjustment handwheel 256. In this way, the axis of the gripper group may be brought into alignment with the axis of the log to be cut, whatever the dimension of the log. The buffers or link blocks 250 may be made according to any of the embodiments discussed with reference to FIG. 4A.

Figure 7:
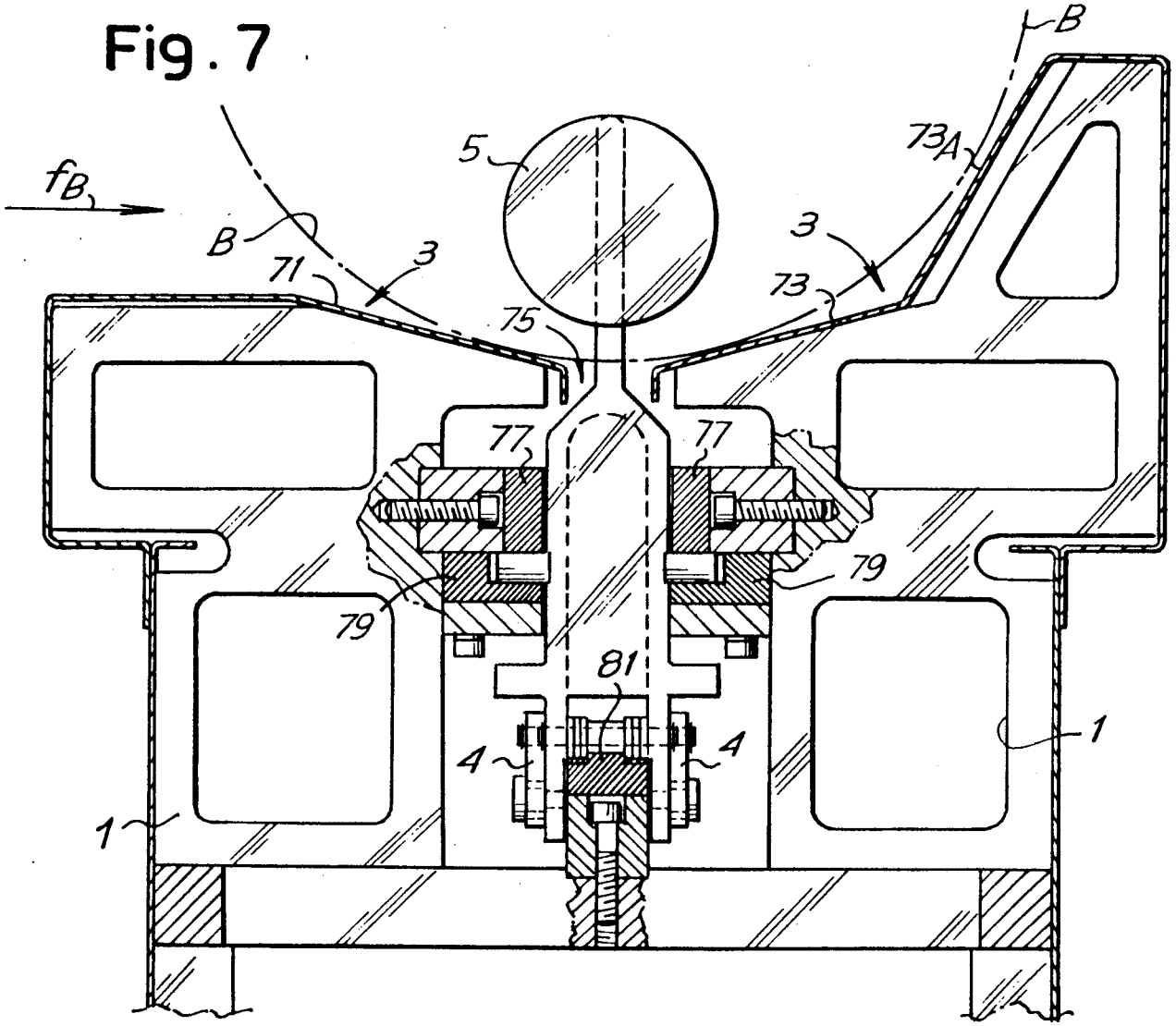
FIG. 7 shows a transverse section of the guides of the roll which is to be cut.

FIG. 7 shows a transverse section of guides 3 for the log B to be cut. Said guides comprise, according to the example illustrated in said FIG. 7, a pair of supports 71, 73 suitably shaped to allow both the sideway movement of log B in the direction fB, and a correct guiding of the log during its intermittent longitudinal feeding movement through the cutting means. More particularly, the support 71, facing the feeding side of the logs, has a low profile, while the support 73 has a portion 73A upwardly inclined to form a side member which stops the log B as it is discharged onto the guides 3 in the direction fB. Between the supports 71, 73, a passage 75 is provided for the transit of pusher 5 driven by the chain means 4. The pusher 5 is guided by suitable side guides 77 and 79, and, at the bottom, by a central guide 81.

Figure 8:
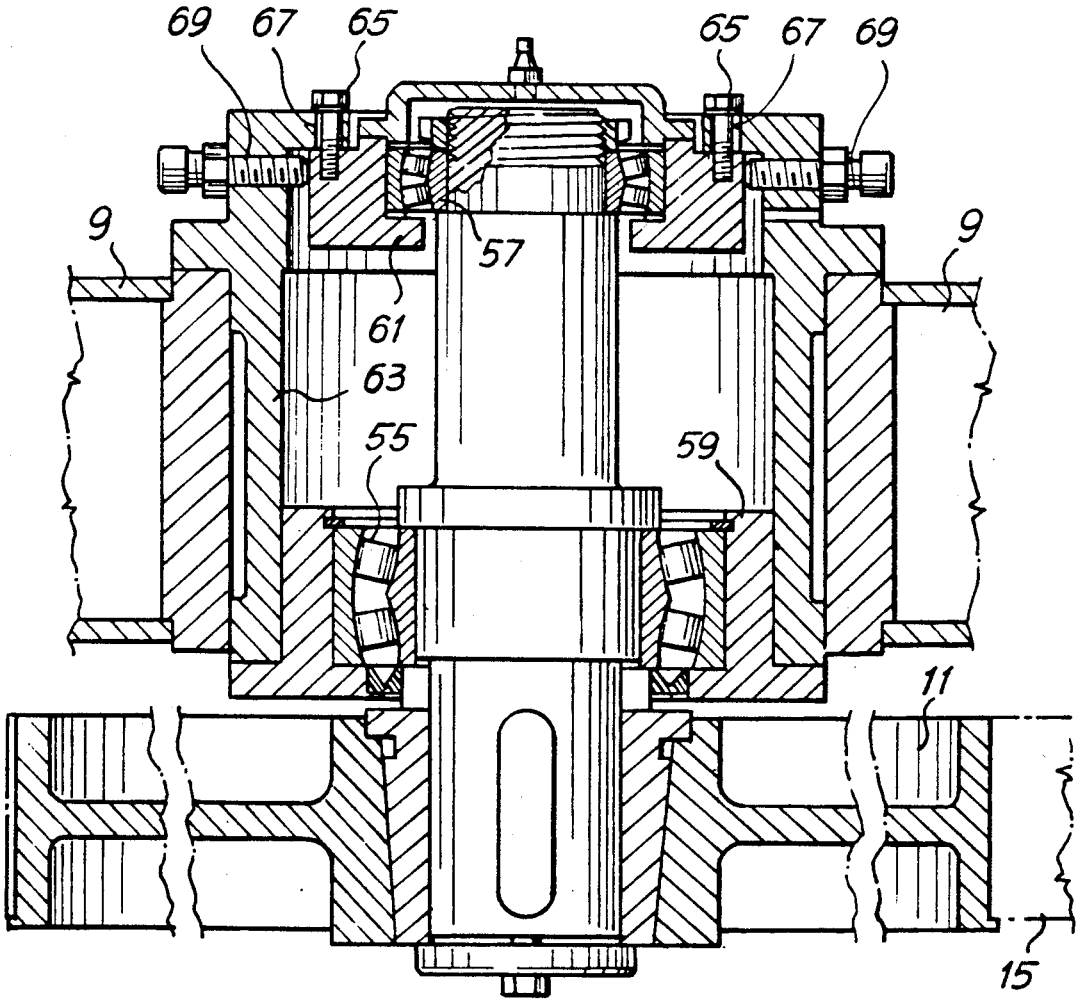
FIG. 8 shows a longitudinal local section of the driven flywheel.

FIG. 8 shows a longitudinal section of the support of the driven flywheel 11, mounted on a shaft 53 supported by a pair of adjustable bearings 55, 57. The first of said bearings 55 is mounted in a counter-flange 59 which is non-movably fixed on the oscillating arm 9, while the second bearing 57 is mounted in a counter-flange 61 which is fitted in an adjustable position in the oscillating arm 9. It is thereby possible to orient the axis of shaft 53 in an optimal position to allow the correct guiding of said band blade 15. To adjust the position of the counter-flange 61 and thus of the bearing 57 with respect to the oscillating arm, said counter-flange 61 is fastened to a main flange 63 which is firmly fixed to the oscillating arm 9 by means of screws 65 going through slotted holes 67 formed into said main flange 63. The position of the counter-flange 61 with respect to the main flange 63 is determined by adjusting screw means 69 engaged to said main flange 63, symmetrically disposed with respect to the axis of shaft 53 and cooperating with the outer cylindrical surfaces of said counter-flange 61. By adjusting the screw means 69, it is possible to vary the position of the counter-flange 61 and thus of the shaft 53 to meet the specific working requirements.

Figure 11:
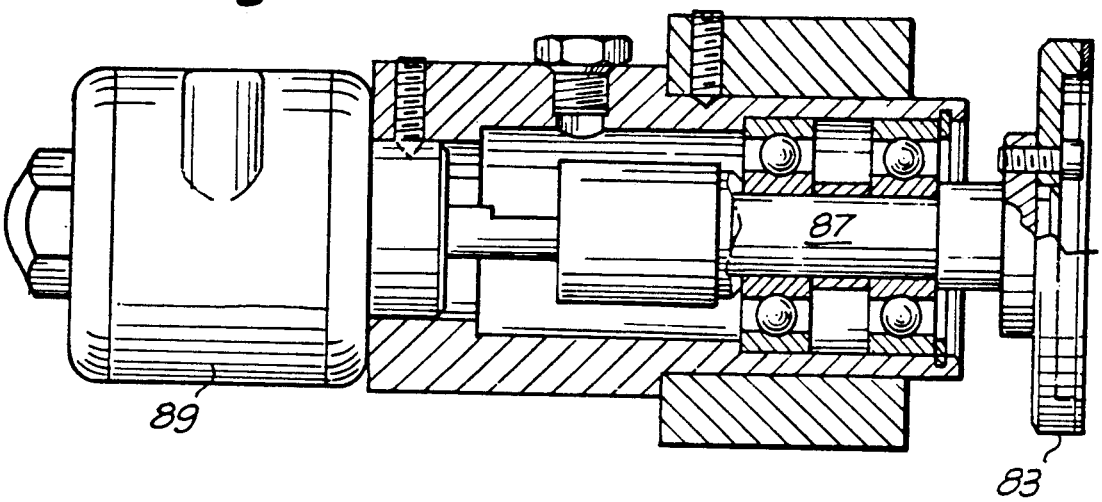
FIG. 11 shows a local section of a grinding wheel of FIG. 9 and of the relevant motor.

FIGS. 9 to 11 show in greater detail the sharpening unit of the band blade 15, located in the zone 10 as indicated in FIG. 1. In the illustrated example, the sharpening unit comprises a first pair of grinding wheels 83, 85 mounted on relevant mandrels 87 (FIG. 11) having skew axes and rotated by pneumatic motors 89, 91 or the like.

Each of the two motors 89, 91 with its grinding wheels 83, 85 is mounted on a respective support 92 fastened to a further support 94 by means of a rotary pivot 93 and by a screw 95 which is engaged to said support 94 through a slot 96 of said first support 92. This allows, when the screw 95 is loose, the adjustment of the relative angular position of the two supports 92, 94 and thus of the axis of the respective grinding wheel. Support 94 is, in turn, connected by screws 97 to the oscillating arm 9. The screws 97 engage the support 94 through slots 99 which allow a relative displacement between the same support 94 and the bracket 98 and thus between the respective grinding wheel and the band blade 15.

The position of support 94 with respect to bracket 98 is adjusted by screw means 100. The oscillation of the support 92 about the pivot 93 and the displacement of support 94 with respect to bracket 98 allow the correct adjustment of the position of the respective grinding wheel as the grinding wheel wears down.

The axes of the grinding wheels 83, 85 have a rather limited inclination to the horizontal so as to form a cutting edge defined by sides 105 (FIG. 9A) forming a relatively narrow angle. The extremely thin and sharp cutting edge which is thus formed does not have a resistance sufficient to carry out the cutting of the logs and would become rapidly damaged from the impurities of the paper to be cut. To avoid this, a further pair of idle grinding wheels are provided downstream of grinding wheels 83 which are mounted at such an angle as to chamfer the cutting edge of the blade 15 formed by the sides 105 ground by wheels 83, 85. In FIG. 9A, the chamfer obtained with these grinding wheels is indicated by 107.

Figure 14:
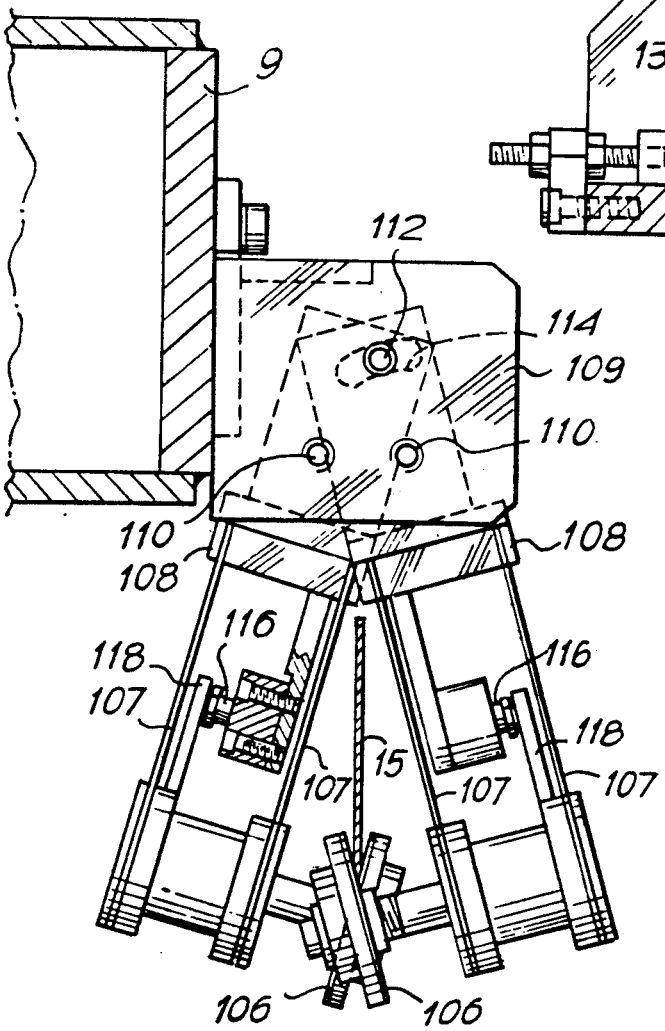
FIG. 14 shows a front view and partial section of the second sharpening unit.

FIG. 14 shows a view and partial section of a pair of idle grinding wheels which form the chamfer of the cutting edge of band blade 15. Said idle grinding wheels, indicated by 106, are each mounted through two elastic laminae 107 carried by respective brackets 108. Each bracket is fastened to the support plate 109 through a pivot 110 about which the relevant bracket 108 can be oriented before being locked in place by a screw 112 which engages a corresponding slot 114 of the relevant bracket 108. The grinding wheels 106 are urged against the edge of the blade 15 by pneumatic pistons 116 cooperating with arms 118 fixed to the respective grinding wheels 106. The group of the idle grinding wheels 106 is placed downstream from the group of motorized grinding wheels 83, 85. If desired, additional sharpening units may be disposed along the band blade 15 at suitable positions.

Figure 12:
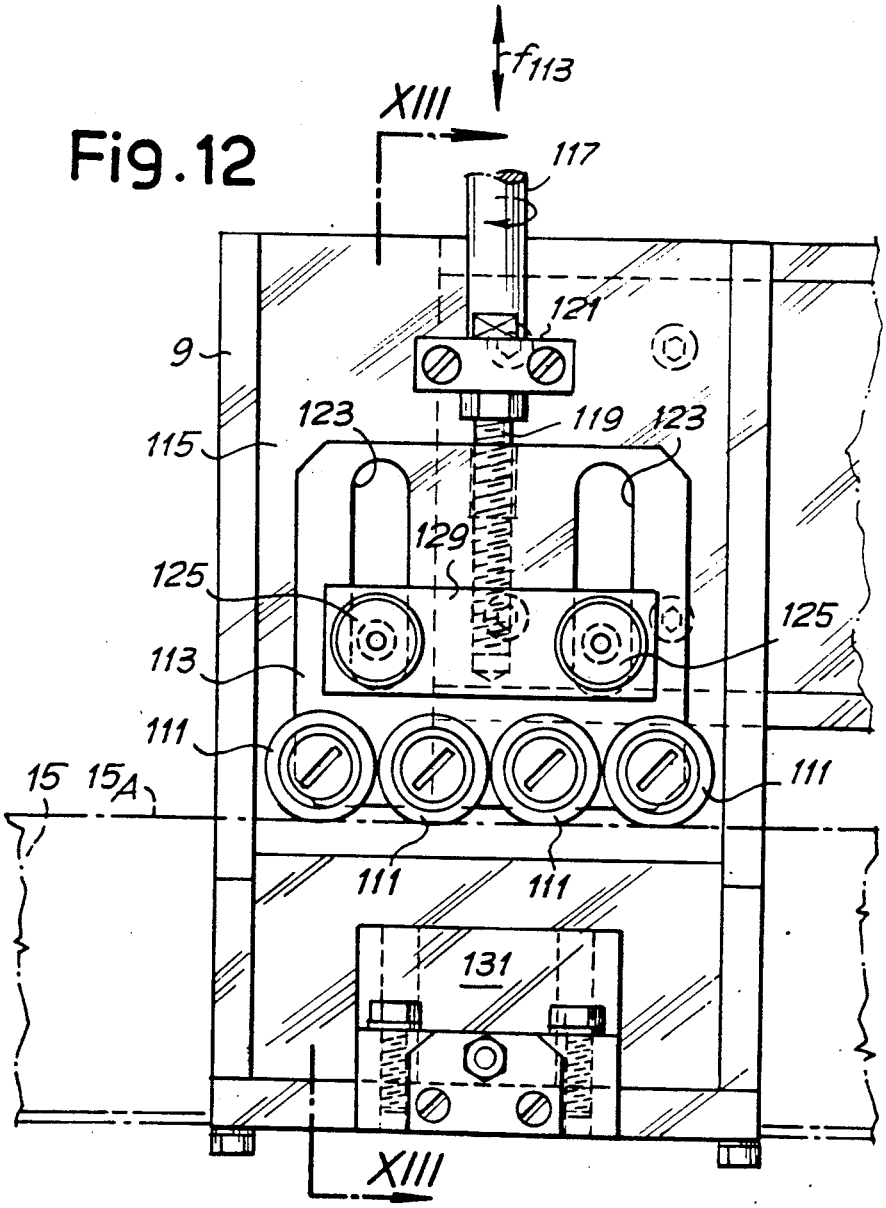
FIG. 12 shows a front view of the blade guiding group.
Figure 13:
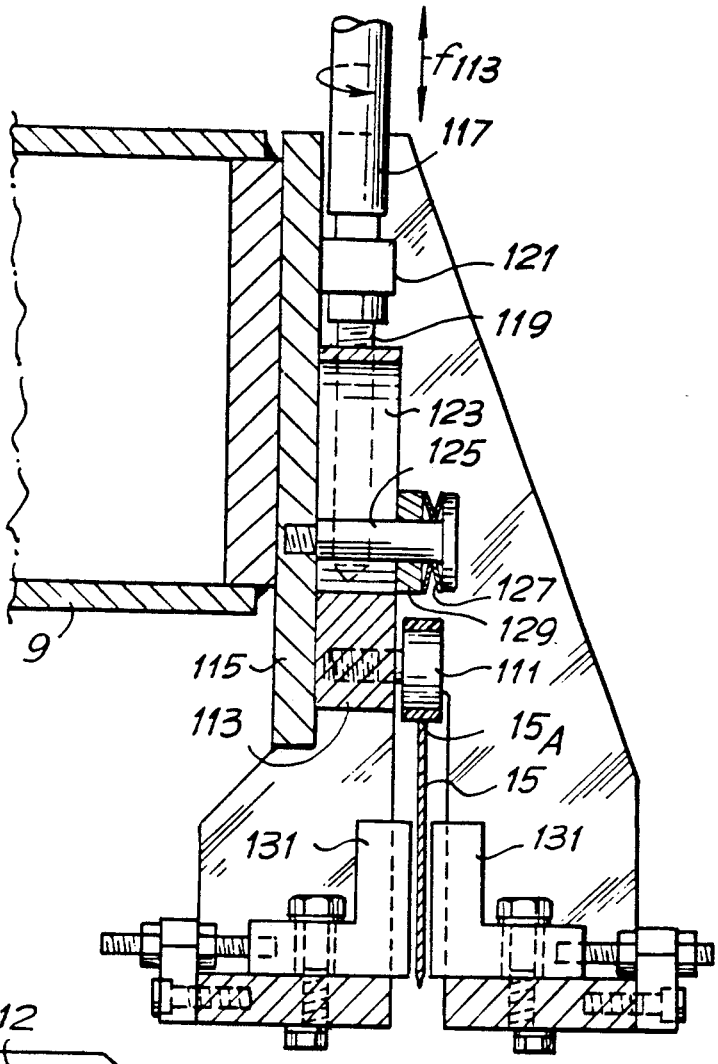
FIG. 13 shows a section taken on line XIII—XIII of FIG. 12.

On the arm 9, in correspondence of the sharpening unit, means are provided for guiding the band blade 15 which have the purpose to keep the blade in position by counteracting its tendency to move upwards due to the resistance of the material being cut FIGS. 12 and 13 show said guide means in front view and in side view. In the illustrated example, said guide means comprise a series of rollers 111 idly mounted onto a unit 113. The upper edge 15A of the band blade 15 rests on the rollers as indicated by a dash-dot line in FIG. 12. The unit 113 is carried by a plate 115 fastened to the oscillating arm 9, and is adjustable into position by a pivot 117 having a threaded portion 119 which engages a corresponding threaded hole of the unit 113. By rotating the pivot 117, which is housed in a seat formed in a block 121, the unit 113, together with relevant idle rollers 111, can be moved in the directions of double arrow f113 up to the desired position. As the band blade 15 becomes worn, the unit 113 and relevant rollers 111 are lowered by the adjustment system as above described, so as to maintain the cutting edge of the blade at the correct position all the time. The unit 113 is proVided with two slots 123 for two threaded pins 125 which are engaged in plate 115. The pins 125 press a member 129, by means of Belleville washer 127, against the unit 113, in order to retain the latter against the plate 115, allowing at the same time adjustment by the pivot 117.

Beneath rollers 111 two facing and slightly spaced L-shaped sections 131 are provided to form a slit between them for the passing of the blade 15. The distance between the facing surfaces of the L-shaped sections 131 is such as to prevent the band blade 15 from twisting.

The described guide system keeps the band blade 15 in the correct position even when meeting the resistance of the paper material to be cut. The reaction of the rolls 111 on the edge 15A of the band blade 15 adds up to the reaction determined by the inclination of the axis of flywheel 11 on which the band blade is driven. The two reactions ensure a perfect positioning of the blade even in presence of heavy forces tending to move it upwardly with respect to the flywheels 11, 13. The described guide system may be positioned at any point of the path of the band blade 15 and does not necessarily need to be disposed in correspondence of the active branch. On the contrary, as illustrated in FIG. 1, the guide system may be positioned also in correspondence of the non-active branch of the blade—that is to say, in a position in which there is more space available for the assembling. In practice, more guide systems may be disposed at suitable positions along the band blade 15. It is, however, suitable that at least one of said guide systems be positioned near the sharpening unit(s).

Figure 15:
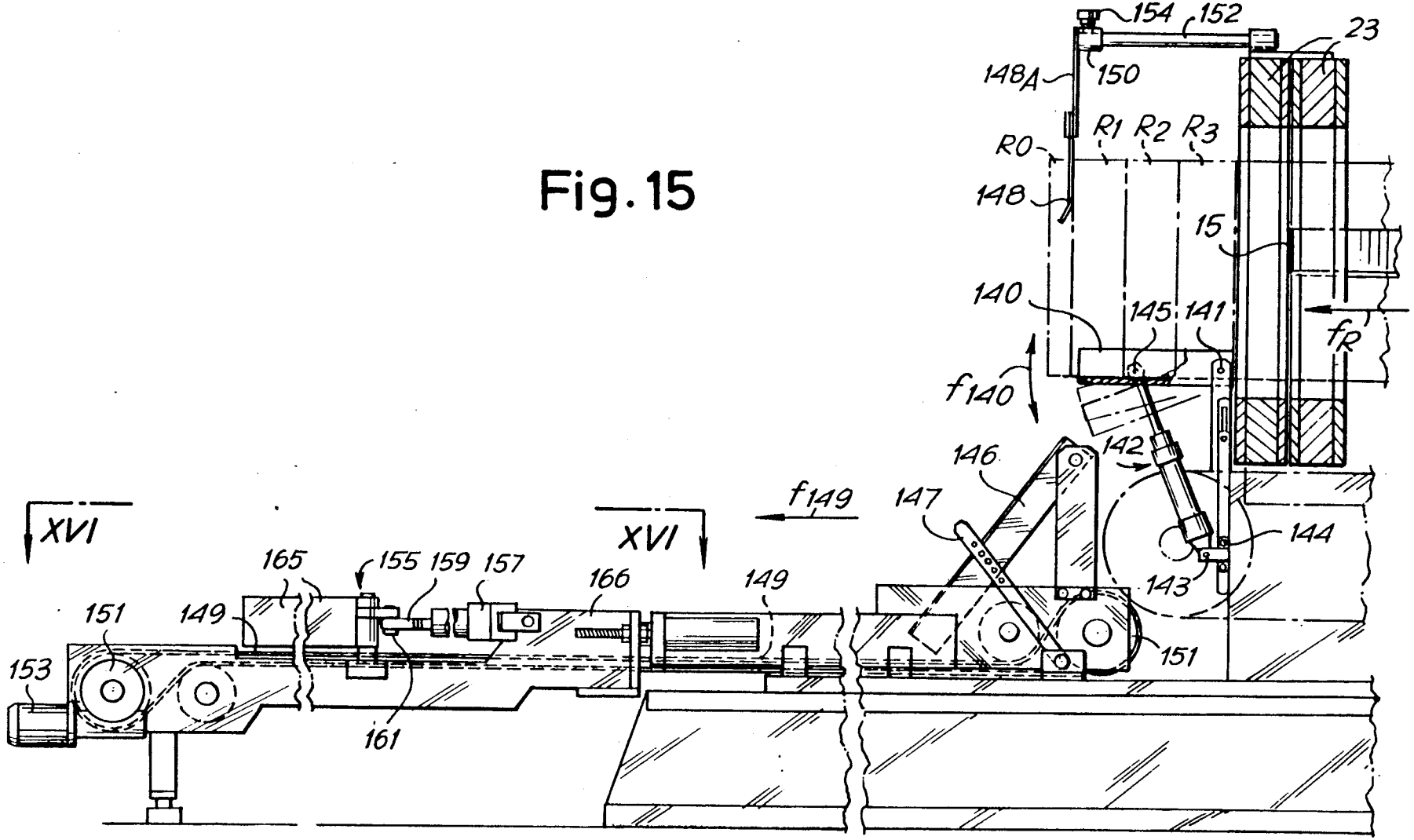
FIG. 15 shows a side view of the device for the discharge of cut rolls and of scrap ends.
Figure 16:
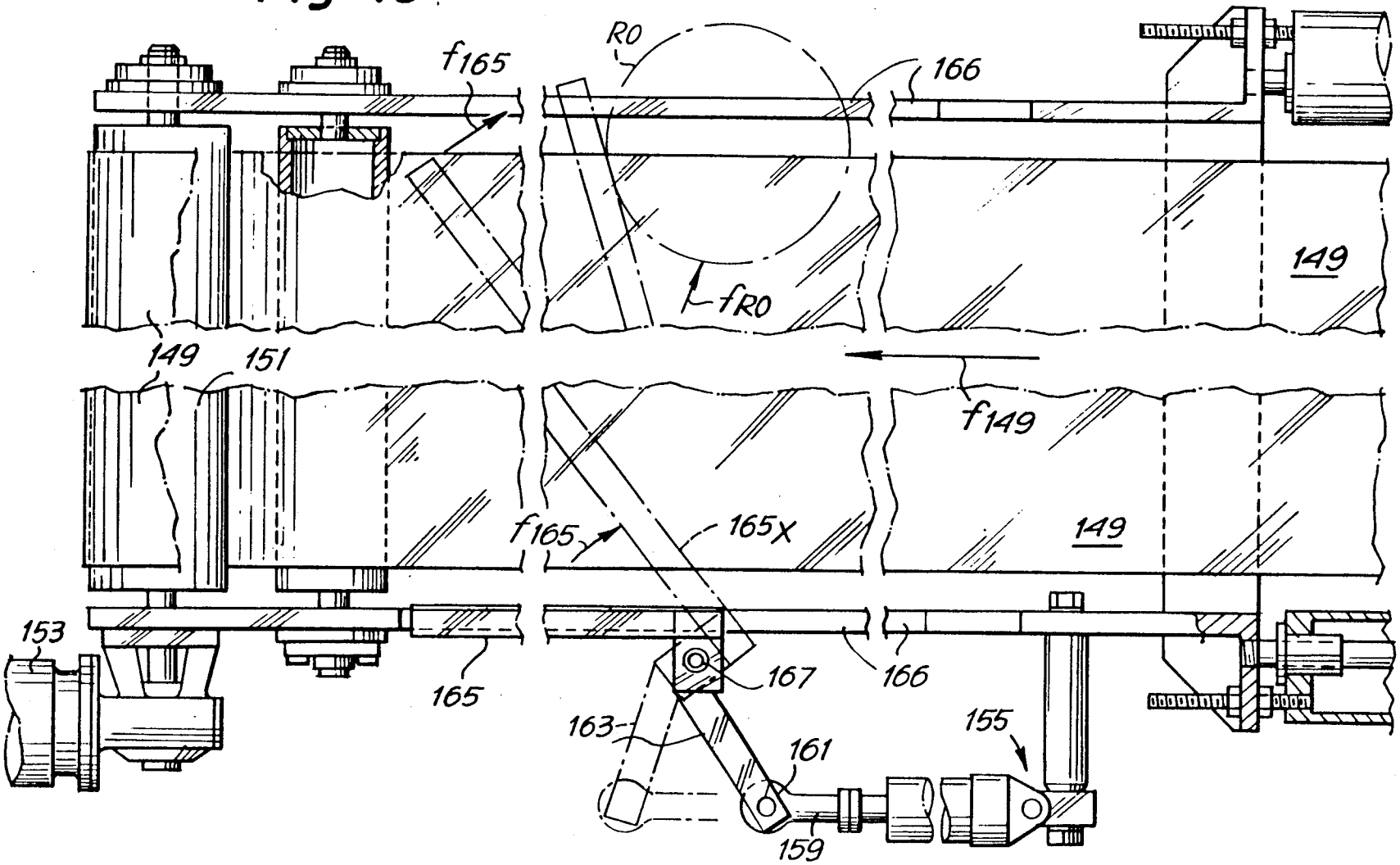
FIG. 16 shows a plan view taken on line XVI—XVI of FIG. 15 of the device for rejecting scrap ends.

FIGS. 15 and 16 show a device for the discharge and removal of the cut rolls and the rejection of scrap ends. The device is disposed downstream of gripper group 23 and is omitted in FIGS. 1 to 3 for sake of clarity. Downstream of said gripper group 23, diagrammatically shown in FIG. 15, a shelf 140 is provided, on which the rolls R1, R2, R3 formed by cutting log B are supported. Rolls R1, R2, R3 are pushed in the direction fR by the same pusher 5 which causes the feeding of log B. The shelf 140 is made to oscillate about a pivot 141 and its oscillation is driven, for the purposes to be described below, by an actuator 142 which, in the illustrated example, is in the form of a cylinder-piston system. The cylinder of said cylinder-piston system is engaged at 143 to a slide 144 adjustable along the vertical direction, while the stem of same cylinder piston system is pivotally fastened at 145 to the shelf 140 to move the shelf in the directions of double arrow f140. To unload the cut rolls R1, R2, R3 and/or the scrap end RO towards conveyor means to be described hereafter, the actuator determines, at a suitable instant, the pivoting of shelf 140 about the pivot 141 and thus the discharge of rolls and/or scrap ends onto a chute 146, whose inclination can be adjusted by means of a bracket 147, for the laying of the rolls onto a belt conveyor 149. To avoid accidental overturning of rolls R1, R2, R3 and of scrap ends RO out of shelf 140 onto chute 145, an elastic lamina 148 is provided engaged to an arm 148A fixed to a sleeve 150 sliding on a horizontal stem 152 and stopped thereon at a suitable position by means of a screw knob 154.

The belt conveyor 149, which moves the cut rolls in the direction f149 towards the next work stations, travels between the two rolls 151, one of which is driven into rotation by a geared motor 153.

When a whole log B is cut, the scrap ends are thrown away. To this purpose, the log B is initially located in the qripper group 23 so that the band blade 15 will cut a thin "slice" of the log no thicker than the bare minimum necessary to eliminate the useless scrap ends of the log. The scrap end indicated by RO in FIG. 15, must be rejected. Similarly, the scrap end formed after the last cutting operation must also be rejected. To this end, at a suitable position of the belt conveyor 149, a device is provided generally indicated by 155 which ejects the scrap ends so that they are not conveyed towards the rolls collection zone.

Said device 155 comprises an actuator 157 connected through a stem 159 and a linkage 161 to a bracket 163 fixed to a portion 165 of the side member 166, which is parallel to the belt conveyor 149. The portion 165 of the side member is pivoted at 167 and can be made to move through the actuator 157 in the direction f165 so as to place itself in a position substantially across the belt conveyor 149 (indicated with a dash-dot line at 165X in FIG. 16).

When a scrap end RO is on the belt conveyor 149, the actuator 157 moves the side member portion 165 in the direction f165 so that such scrap end is ejected in the direction fRO until it falls off the belt conveyor 149 into a storage container or onto another conveyor suitably positioned near an aperture in the side member on the other side of the same belt conveyor 149. The whole apparatus may be programmed, according to the length of the logs to be cut and to the height of rolls to be obtained, in order to automatically put the device 155 into operation whereby to discharge the scrap ends.

The discharge of the scrap ends may be carried out also without using movable members and relevant actuators. In fact, the scrap ends are always less high than the rolls. It is thus possible to provide a cross-piece disposed above the belt conveyor 149 at such a height (possibly adjustable to fit the different heights of rolls and scrap ends) as to divert the rolls into a pre-determined direction, while allowing the scrap ends to pass underneath towards a collection zone.

When the pusher 5 moves the log B forward and then stops after a displacement corresponding to the size of the roll or of the scrap end to be cut, it is necessary for the log to stop almost instantaneously to avoid inertia-operated feeding travel which would cause the cut rolls to be of non-uniform size. To this end, according to the illustrated example, means are provided to stop the log B, thereby preventing the advancement of the latter by inertia when the pusher 5 comes to a stop. FIGS. 17 and 18 show a partial front view and a local section of a device able to stop the advancing log. Said device is located in the position schematically illustrated at 24 in FIG. 3 and comprises a pair of posts 170 forming a side support for a bracket 171 vertically movable on said posts. To allow the adjustment in height of bracket 171, this is engaged to a threaded pivot 173 which fits into a threaded bush 175 fixed to a handwheel 177 and housed in a seat formed in a fixed cross-piece 179 fastened to the posts 170. Supports 181 are proVided on bracket 171 and symmetrically disposed to the plane of symmetry of same bracket 171. Each support carries a pair of pushers 183 represented in partial longitudinal section in FIG. 17 which, by means of compression springs 185, urge a stem 189 towards the log B. Said stem carries a block of elastic material 191 at its lower end, acting as a damper.

Fastened to the blocks 191 of each pair of pushers 183 is a skid 193 having a bevelling 193A on the side facing the part opposite the cutting zone. The two skids 193 (only one of which can be seen in FIGS. 17 and 18) are urged by the respective springs 185 towards the cylindrical surface of the log B and, by pressing against it, prevent the advancement by inertia of same log. The supports 181 can be moved in the directions of double arrow f181 along the bracket 171, this adjustment, together with the adjustment that can be obtained through the handwheel 177, allowing the position of skids 193 to be adjusted to the various diameters of the logs that may be cut by the cutting-off machine.

When the log has been almost completely cut, its terminal portion is no longer in contact with the skids 193 and is no longer stopped by them. To avoid that even the last portion of the log to be cut is moved forwards by inertia, braking means may be located near the gripper group. In particular, to this end, provision may be made that some of the buffers or link blocks 47, associated with the gripper member upstream of the cutting zone with respect to the log feeding direction, be equipped with braking means able to brake the log portion which is inside said gripper member. This is the case also when the buffers 47 are in retracted position--that is to say, when they do not clamp the log.

FIG. 19 shows a section of a buffer 195 on which, by means of a plate 194 and of screw means 196, a leaf spring 197 is anchored, projecting towards the center of the transit seat of the log, to cause the braking thereof by friction. By providing a certain number of buffers 195 supplied with springs 197 and symmetrically disposed in place of buffers 47 on the gripper member upstream of the cutting zone, it is possible to prevent also the inertia advancement of the last portion of the log.

FIG. 20 shows, similarly to FIG. 2, a front view of a cutting-off machine according to the invention in a modified embodiment thereof. In this Figure, like numbers indicate corresponding parts of the embodiment previously described. This embodiment differs from the previous one because of the different configuration of the guide for the logs to be cut and of the gripper group. In the embodiment shown in FIG. 20, the cutting-off machine is able simultaneously to cut two logs B11, B12 of smaller diameter, which rest onto guide means formed by two fixed supports 201, 203 and by two movable supports 205, 207. The supports 205, 207 are fastened to two connecting rods 209, 211 hinged to a stem of a cylinder-piston actuator 213 which can move said supports 205,207 between the position shown in FIG. 20 and a position in which they form a single cradle with the fixed supports shapes 201 and 203. This allows the loading of both logs B11, B12 from the same side by placing the intermediate supports 209, 211 in such a position as to form a single cradle with the fixed supports 201, 203 and then move away, that is to say, spread apart the so-loaded logs thereby forming two separate cradles or guides, as shown in FIG. 20. This allows two distinct pushers (not shown) similar to pusher 5 to feed the logs towards the blade 15.

The clamping of logs B11, B12 during the cutting takes place by means of respective flexible laminae generally indicated by 215 and 217 and anchored to a fixed central element 219 and to the stems of two cylinder-piston actuators 221, 223 capable of tensioning the laminae 215, 217 to clamp the logs B11, B12 during the cutting. In practice, for each log B11, B12 there is provided a laminae both upstream and downstream of the operative zone of the band blade 15, with a disposition operatively corresponding to that of the two clamping members illustrated in FIGS. 4A, 4B, 5 and 6.

With the arrangement illustrated in FIG. 20, the cutting-off machine is able to cut two logs at one time, but it is evident that, with small variations, it is possible to cut also more logs simultaneously. The previously-described elements, especially the braking means intended to prevent the advancement of the log by inertia, the devices for the discharge of the rolls and of the scrap ends and the sharpening and guiding means for the band blade, may be used on the cutting-off machine of FIG. 20, this being different from the preceding solution merely because of the configuration of the log guide and the gripping means. By simply replacing the gripping means, the cutting-off machine of FIG. 20 can be adapted for a single log B13 of greater diameter (hatch drawn in FIG. 20). In this case, the log guiding system may remain the same and be formed by the structural shapes 201, 203, 205, 207 with the intermediate structural shapes 205, 207 being in lowered position to form a single cradle. The dual pushers may be used to advance the single log B13 of greater diameter.

Accordingly, a single cutting-off machine may be used for all the range of log diameters by simply replacing the gripping group. The latter, in case of a single log, can take the form illustrated either in FIG. 4A or 4B or 20 according to requirements. The gripper group with flexible lamina, of the type illustrated in FIG. 20, may be obviously used for a single log only, also in the embodiment of FIG. 1 in which the cutting-off machine is provided with the roll guide having a fixed configuration.

The embodiment of FIG. 20, which is able to cut two logs simultaneously, allows the productivity of the cutting-off machine to be suited to the productivity of a rewinder for the production of logs having a small diameter, which would have otherwise too high a throughput to be absorbed by a cutting-off machine able to cut one log at a time.

It is understood that the drawing shows a practical exemplification of the invention, as this may vary in the forms and dispositions without departing from the scope of the idea on which the same invention is based. The reference numbers in the attached claims are intended to facilitate the reading of the claims by reference to the description and the drawing, and does not limit the scope of the protection represented by the claims.

Having thus described my invention, what I claim as new and desire to protect by Letters Patent are the following:

1. Apparatus for cutting logs (B) of paper material or the like into a plurality of rolls (R1, R2, R3) of desired height, said apparatus including:
   - means (3) for the longitudinal support and guidance of one or more logs (B) to be cut,
   - means (4, 5) for advancing said log(s),
   - means for braking the advancing log(s),
   - a gripper group (23) able to surround the entire log and to retain said log(s) during the cutting,
   - cutting means (15) mounted on an arm (9) provided with reciprocating or oscillating motion,
   - wherein said cutting means (15) includes a band blade (15) with a non-serrated cutting edge, driven between two flywheels (11, 13) supported by said arm (9), and a motor 17 to drive one of said flywheels,
   - wherein at least one of said flywheels (11, 13) is supported on a shaft (53) having adjustable inclination means (65, 67, 69) being provided to adjust and stabilize the angular position of said shaft.

2. Apparatus for cutting logs (B) of paper material or the like into a plurality of rolls (R1, R2, R3) of desired height, said apparatus including:
   - means (3) for the longitudinal support and guidance of one or more logs (B) to be cut,
   - means (4, 5) for advancing said log(s),
   - means for braking the advancing log(s),
   - a gripper group (23) able to surround the entire log and to retain said log(s) during the cutting,
   - cutting means (15) mounted on an arm (9) provided with reciprocating or oscillating motion,
   - wherein said cutting means (15) includes a tensioned band blade (15) with a non-serrated cutting edge, driven between two flywheels (11, 13) supported by shafts mounted on said arm (9), and a motor 17 to drive one of said flywheels,
   - wherein the center distance between said two flywheels (11, 13) can be adjusted to change the tension on said band blade (15), and
   - wherein the shaft of one of said flywheels is supported by a double, L-shaped bracket (18) articulated (at 19) to a point on said arm (9), an actuator

(20) being provided to allow the oscillation of said double bracket about the articulation point (19) on the arm (9).

3. Apparatus for cutting logs (B) of paper material or the like into a plurality of rolls (R1, R2, R3) of desired height, said apparatus including:

means (3) for the longitudinal support and guidance of one or more logs (B) to be cut, means (4, 5) for advancing said log(s), means for braking the advancing log(s), a gripper group (23) able to surround the entire log and to retain said log(s) during the cutting, and cutting means (15) mounted on an arm (9) provided with reciprocating or oscillating motion, said cutting means comprising a blade having two sides and a cutting edge, sharpening means associated with said arm for sharpening said cutting blade, and wherein said sharpening means comprise a first pair (83, 85) of idly mounted grinding wheels for grinding the sides of the blade, and a second pair of idly mounted grinding wheels (106), being inclined relative to said first pair of grinding wheels, for grinding the cutting edge of the blade.

4. Apparatus for cutting logs (B) of paper material or the like into a plurality of rolls (R1, R2, R3) of desired height, said apparatus including:

means (3) for the longitudinal support and guidance of one or more logs (B) to be cut, means (4, 5) for advancing said log(s), means for braking the advancing log(s), a gripper group 923) able to surround the entire log and to retain said log(s) during the cutting, cutting means (15) mounted on an arm (9) provided with reciprocating or oscillating motion, wherein at least two parallel guides 201, 203, 205, 207) and at least two gripper groups are provided for the advancement and the simultaneous cutting of two logs (B11, B12), and wherein means (209, 211, 213) are provided for changing the conformation of said two guides in order to change from a dual guide configuration to a single guide configuration and vice versa.

5. Apparatus for cutting logs (B) of paper material or the like into a plurality of rolls (R1, R2, R3) of desired height, said apparatus including:

means (3) for the longitudinal support and guidance of one or more logs (B) to be cut, means (4, 5) for advancing said log(s), means for braking the advancing log(s), a gripper group (23) able to surround the entire log and to retain said log(s) during the cutting, cutting means (15) mounted on an arm (9) provided with reciprocating or oscillating motion, wherein said gripper group (23) includes on each side of the cutting zone, a frame (25) supporting a plurality of slides (45), buffers (47) to act upon the cylindrical surface of the log (B1, B2) during the cutting, means (31-43) to simultaneously move said slides (45) against the cylindrical surface of the log (B1, B2) to be cut, and wherein said means for simultaneously moving said slides (45) includes a ring (31) surrounding the transit zone of the log (B1, B2) to be cut, a plurality of slots (41) inclined to the radial direction, a pivot (43) in each of said slots being engaged, connected to a corresponding slide (45), and an actuator (34) rotating said ring (31) in one direction or the other.

6. Apparatus for cutting logs (B) of paper material or the like into a plurality of rolls (R1, R2, R3) of desired height, said apparatus including:

means (3) for the longitudinal support and guidance of one or more logs (B) to be cut, means (4, 5) for advancing said log(s), means for braking the advancing log(s), a gripper group (23) able to surround the entire log and to retain said log(s) during the cutting, cutting means (15) mounted on an arm (9) provided with reciprocating or oscillating motion, wherein said cutting means (15) includes guide means and a band blade (15) with a non-serrated cutting edge, driven between two flywheels (11, 13) supported by said arm (9), and a motor 17 to drive one of said flywheels, wherein said guide means comprise a plurality of idle-rolls (111) cooperating with the upper edge (15A) of said band blade (15), and wherein said idle-rolls (111) are carried by a unit (113) that can be adjusted in position to make up for the wear of said band blade (15).

7. Apparatus for cutting logs (B) of paper material or the like into a plurality of rolls (R1, R2, R3) of desired height and scrap ends of less than the desired height, said apparatus including:

means (3) for the longitudinal support and guidance of one or more logs (B) to be cut, means (4, 5) for advancing said log(s), means for braking the advancing log(s), a gripper group (23) able to surround the entire log and to retain said log(s) during the cutting, cutting means (15) mounted on an arm (9) provided with reciprocating or oscillating motion, wherein conveyor means (146, 149) are provided downstream of the cutting zone for picking up and moving away the cut rolls (R1, R2, R3), wherein a device (155) is associated to said conveyor means able to move the scrap ends (RO) from the conveyor, and wherein said device (155) able to remove the scrap ends comprises a cross-piece disposed above the conveyor for said cut rolls, at such a height from the plane of said belt conveyor as to allow the scrap ends to pass below said cross-piece, while the cut rolls are diverted by the said cross-piece to further conveyor or collection means.

8. Apparatus for cutting logs (B) of paper material or the like into a plurality of rolls (R1, R2, R3) of desired height, said apparatus including:

means (3) for the longitudinal support and guidance of one or more logs (B) to be cut, means (4, 5) for advancing said log(s), mean for braking the advancing log(s), a gripper group (23) able to surround the entire log and to retain said log(s) during the cutting, cutting means (15) mounted on an arm (9) provided with reciprocating or oscillating motion, wherein said gripper group (23) includes on each side of the cutting zone, a frame (25) supporting a plurality of slides (45), buffers (47) to act upon the cylindrical surface of the log (B1, B2) during the cutting, means (31–43) to simultaneously move said slides 945) against the cylindrical surface of the log (B1, B2) to be cut, and wherein said buffers (47) can be replaced to fit the machine to the cutting of logs of different diameters.

9. Apparatus for cutting logs (B) of paper material or the like into a plurality of rolls (R1, R2, R3) of desired height and scrap ends of the less than the desired height, said apparatus including:

means (3) for the longitudinal support and guidance of one or more logs (B) to be cut, means (4, 5) for advancing said log(s), means for braking the advancing log(s), a gripper group (23) able to surround the entire log and to retain said log(s) during the cutting, cutting means (15) mounted on an arm (9) provided with reciprocating or oscillating motion, wherein conveyor means (146, 149) are provided downstream of the cutting zone for picking up and moving away the cut rolls (R1, R2, R3), wherein a device (155) is associated to said conveyor means able to move the scrap ends (RO) from the conveyor, and wherein said device (155) comprises an actuator (157) able to control the oscillation of a member (165) capable of intercepting the scrap ends (RO) which are on the conveyor means (149) and divert them out of the path of said rolls (R1, R2, R3).

10. Apparatus for cutting logs (B) of paper material or the like into a plurality of rolls (R1, R2, R3) of desired height, said apparatus including:

means (3) for the longitudinal support and guidance of one or more logs (B) to be cut, means (4, 5) for advancing said log(s), means for braking the advancing log(s), a gripper group (23) able to surround the entire log and to retain said log(s) during the cutting, cutting means (15) mounted on an arm (9) provided with reciprocating or oscillating motion, wherein means (170–193) are provided upstream of the cutting zone of the log for braking the advancing log, and wherein said means for braking the log comprise skids (193) elastically urged against the cylindrical surface of the log (B) to be cut, the position of said skids (193) being adjustable according to the dimensions of said log (B).

* * * * *